US005310082A

United States Patent [19]

Coustenoble

[11] Patent Number: 5,310,082

[45] Date of Patent: May 10, 1994

[54] APPARATUS FOR DISPENSING MEDICATIONS IN CAPSULE OR PILL FORM

[75] Inventor: Jean-Pierre Coustenoble, Puteaux, France

[73] Assignee: Physior, Puteaux, France

[21] Appl. No.: 9,943

[22] Filed: Jan. 27, 1993

[30] Foreign Application Priority Data

Jan. 29, 1992 [FR] France ..... 92 00958

[51] Int. Cl.[5] ..... G07F 11/00

[52] U.S. Cl. ..... 221/2; 221/83; 221/84; 221/197; 221/287

[58] Field of Search ..... 221/83, 84, 82, 85, 221/81, 79, 76, 155, 197, 287, 3, 2

[56] References Cited

U.S. PATENT DOCUMENTS 1,488,109 3/1924 Gemmeinhardt ..... 221/79
3,297,198 1/1967 Wright, Jr. ..... 221/82 X
3,410,450 11/1968 Fortenberry ..... 221/84 X
3,861,562 1/1975 Owen ..... 221/85
4,785,969 11/1988 McLaughlin ..... 221/83 X

*Primary Examiner*—David H. Bollinger
*Attorney, Agent, or Firm*—Staas & Halsey

[57] ABSTRACT

A dispenser apparatus (1, 60) for medications (2) in capsule or pill form includes a case (3, 64) dispensing the medications and a removable loader (4, 75) capable of containing the medications previously put into the loader. The case includes a driving mechanism (7, 61) for driving the loader in a given direction, and optical detection (39) arranged in order to detect the passage of a medication at the moment of its exit from the case and connected to a electronic device (40) for storing, computing and retrieving the data relating to the dispensing of medications. The loader includes several transverse compartments (24) forming a continuous longitudinal chain, the loader and the orifice being arranged in order to allow the exit of the medication directly under gravity when it is dispensed.

9 Claims, 3 Drawing Sheets

APPARATUS FOR DISPENSING MEDICATIONS IN CAPSULE OR PILL FORM

The present invention relates to a dispenser apparatus for medications in capsule or pill form, comprising a case dispensing the medications and a removable loader capable of containing the medications previously put into the loader, the case comprising on the one hand means for driving the loader in a given direction, in order to bring each of the medications successively, one by one, above an exit orifice of the case, and on the other hand optical detection means disposed in proximity to the said orifice, arranged in order to detect the passage of a medication at the moment of its exit from the case and connected to electronic means for storing, computing and retrieving the data relating t the dispensing of medications.

It finds a particularly advantageous, but not exclusive, application in the field of monitoring the taking of medications by a user. This type of device is in particular advantageously used during the approval stage of a new medical treatment, and is recommended for use with new medications.

A dispensing apparatus of the type defined hereinabove is already known (WO 90/05684).

This known apparatus, however has drawbacks. It in fact requires a loader in the form of a small plate into which are inserted the medications in the form of rigid pills which can be ejected from the said holder or loader by pressure.

Such a design does not allow in particular less rigid medications to be dispensed and/or the same loader to be used in order to dispense medications of substantially different form.

The present invention aims to provide an apparatus which answers practical requirements better than those previously known, and in particular in that it allows, with the same loader, medications having substantially different forms to be dispensed, which medications can be equally well flexible capsules or rigid pills, and to do this in a manner which is simple and easy to use.

Furthermore, the invention, which uses the known means for direct detection of the passage of the medication at the time of its exit from the case before use, does not require an external pressure stress to be exerted on the medication itself in order to dispense the latter.

For this purpose, the invention in particular provides a pocket dispenser apparatus for medications in capsule or pill form of the type defined hereinabove, characterised in that the loader comprises several transverse compartments forming a continuous longitudinal chain, each compartment being open on the side of the exit orifice, closed on the other side and capable of storing one medication, and in that the loader and the orifice are arranged in order to allow the exit of the said medication directly under gravity when it is dispensed.

In advantageous embodiments of the invention, one and/or other of the following arrangements are furthermore resorted to:

the orifice comprises a closure flap arranged so as to retract when a new compartment is presented above the orifice and to reclose after the medication has passed. Such an arrangement in particular makes it possible to protect the optical detection means against light and dust;

the compartments are formed from cells of cylindrical or substantially cylindrical tubular shape, of diameter between of the order of 8 mm and of the order of 1.5 cm and of height between of the order of 5 mm and of the order of 2.5 cm, advantageously of height of the order of 2 cm;

the device comprises means for connection to an external data processing and retrieval system;

the drive means comprise a toothed wheel capable of guiding and meshing step by step with the chain of compartments, for example via click means;

the loader comprises at least 20 compartments and advantageously of the order of 30 compartments;

the device comprises means for locking the case capable of preventing the removal of the removable cartridge, without the use of a key, for example before the chain of medications is completely finished. Such a possibility of locking is useful when the following of a treatment by the user, in particular during approval stage trials of the said medication, is being monitored;

the optical detection means comprise optoelectronic means comprising first means for emitting visual or infrared radiation and second means for receiving the said radiation, the said first and second means being placed opposite each other on a medication exit channel situated between the plane comprising the open ends of compartments and the exit orifice;

the compartments and the lid of the case respectively comprise an external lateral wall which is at least partially transparent, so as to allow a user to observe the contents of the compartments.

The invention will be better understood on reading the description which follows of two particular embodiments which ar given by way of non-limiting example. The description refers to the figures which accompany it in which.

Figure 1:
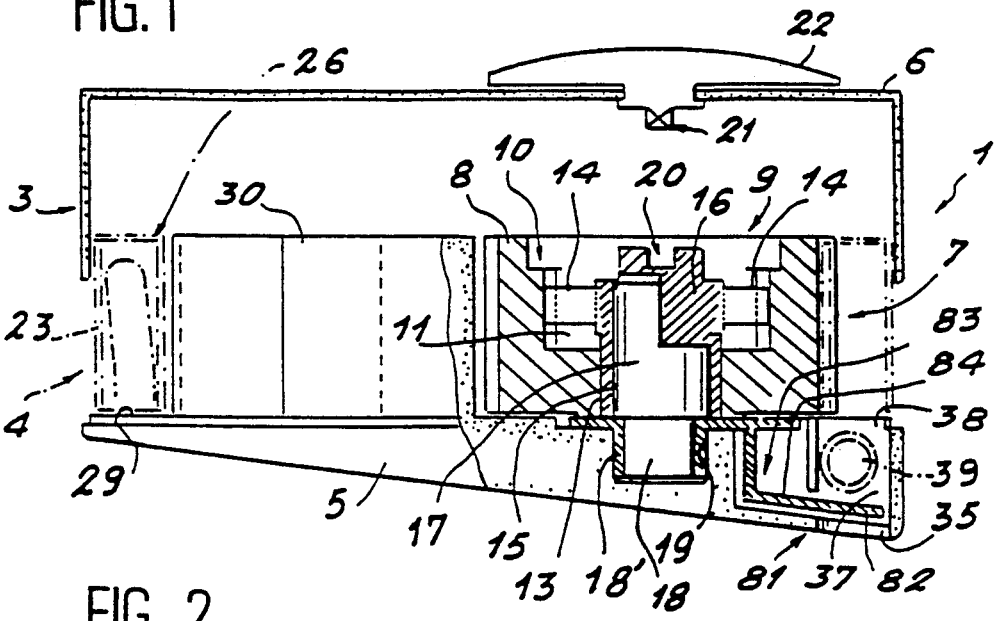
FIG. 1 is a side view, partially in section, of a first embodiment of an apparatus according to the invention whose case is partly open.
Figure 2:
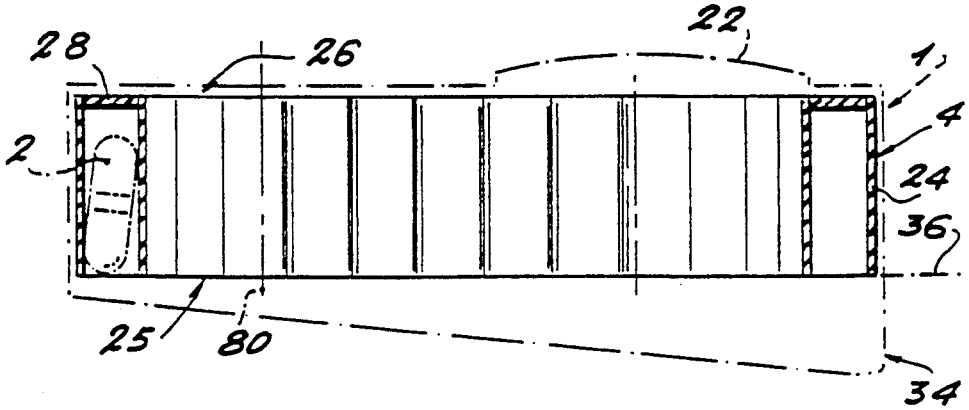
FIG. 2 is a lateral sectional view of the loader of the apparatus in FIG. 1.
Figure 3:
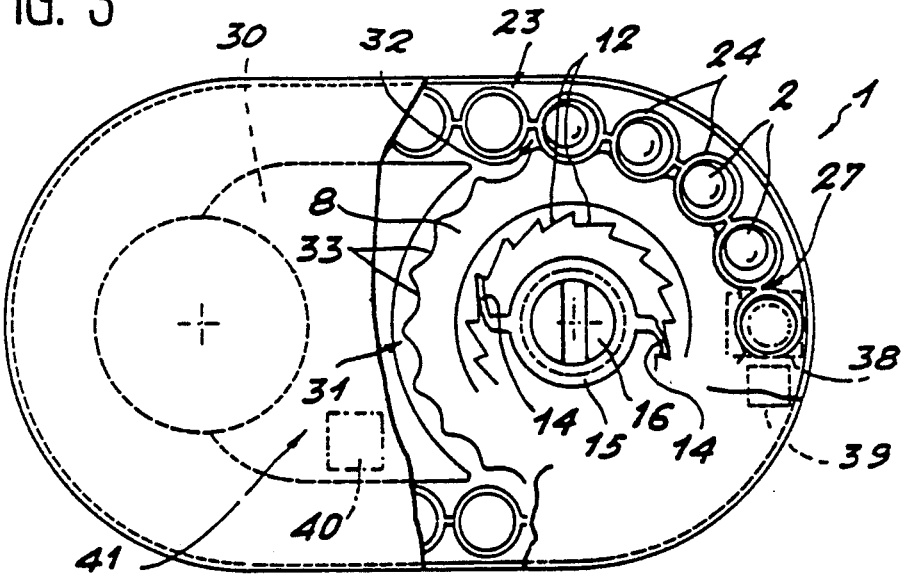
FIG. 3 is a partially exploded top view of FIG. 1.

FIGS. 1, 2 and 3 show a pocket dispenser apparatus 1 for medications 2 in capsule or pill form, comprising a case 3 and a loader 4 which can be removed from the case, capable of containing the medications put one by one into the said loader.

The case comprises a base 5 and a lid 6. The base supports the means 7 for driving the loader.

The means 7 comprise a thick toothed wheel 8 pierced right through with an axial bore 9 comprising a first end bore part 10, a second cylindrical middle bore part 11 fitted with notches 12 regularly distributed over the internal wall of the said bore part 11, and a third end bore part 13.

The notches 12 are capable of interacting, in a manner which is known per se, with two click arms 14 integral with an axial tube 15 covered by a bell-shaped part 16 linked in rotation with the tube 15 with which it is for example screwed.

The axial tube 15 is fixed with loose fit onto a cylindrical central axle 17, which is itself connected with the base 5 via a fastening stud 18 which is inserted, for example, into the tubular part 18', itself interacting externally with a loose fit with a cell 19 of the base 5, which is of complementary shape with the stud, as will be seen further on.

The bell-shaped part 16 is provided with a groove 20 at its upper part, arranged in order to interact with a parallelepipedal lug 21 integral with a circular cap 22 external to the lid of the case, for driving the toothed wheel 8 in rotation step by step, in a manner which is known per se, via the click arm 14.

The cap 22 which is, for example, substantially circular, comprises a rotational axle terminated by the said lug 21, which passes through the lid 6 via a cylindrical opening with which the axle interacts with a loose fit, in a rotational manner. A projecting part holds the cup firmly fixed to the lid.

The loader 4, for example, consists of an endless chain 23 of cell-shaped compartments 24 in which the medications 2 are disposed.

More precisely, the chain 23 comprises for example thirty compartments configured like a noria.

Each compartment is in the form of a cylindrical tube whose axis is directed in the transverse (thickness) direction of the apparatus. Each compartment is connected to two adjacent compartments respectively by a flexible tongue 27, each compartment being open on one side 25 and closed on the other side 26 by a bottom consisting for example of a washer 28. The chain is for example made of flexible plastic (elastomer), the case being for example made of a rigid plastic such as PVC.

The base comprises a plate 29 for holding the medications in their compartments, when the loader is inverted and fitted into the case, and means 30 for guiding the chain in order to guide it when it rotates step by step all around the case.

In order to allow this rotation, the teeth 31 of the wheel 8 are of complementary shape to the external walls 32 of the compartments 24, that is to say substantially in the form of ribs with axes which are transverse with respect to the case, the internal parts 33 intermediate between two adjacent teeth forming portions of cylindrical sectors.

The base comprises, on the side of one longitudinal end, a thicker part 34, fitted with a circular orifice 35 at its bottom part, for the medications to exit from the case, of internal diameter greater than or equal to the diameter of a compartment. This orifice connects with the lower plane 36 of the compartments of the loader 4 via a cylindrical channel 37 of the same diameter which emerges on the other side on a circular opening 38, still of the same diameter, in the plate 29.

The channel and the orifices are therefore of dimensions which are sufficient in order to allow the medication to pass easily and under gravity, from the compartment where it is stored to the exit orifice 35.

The channel 37 is furthermore fitted with optical detection means 39, situated in proximity to the orifice 35, arranged in order to detect the passage of a medication through the channel at the moment of its exit from the case.

The means 39 are connected to electronic means 40 for storing, computing and retrieving the data relating to the dispensing of the medications. The means 40 are situated in the central part 41 of the case, integral with the base 5.

Figure 4:
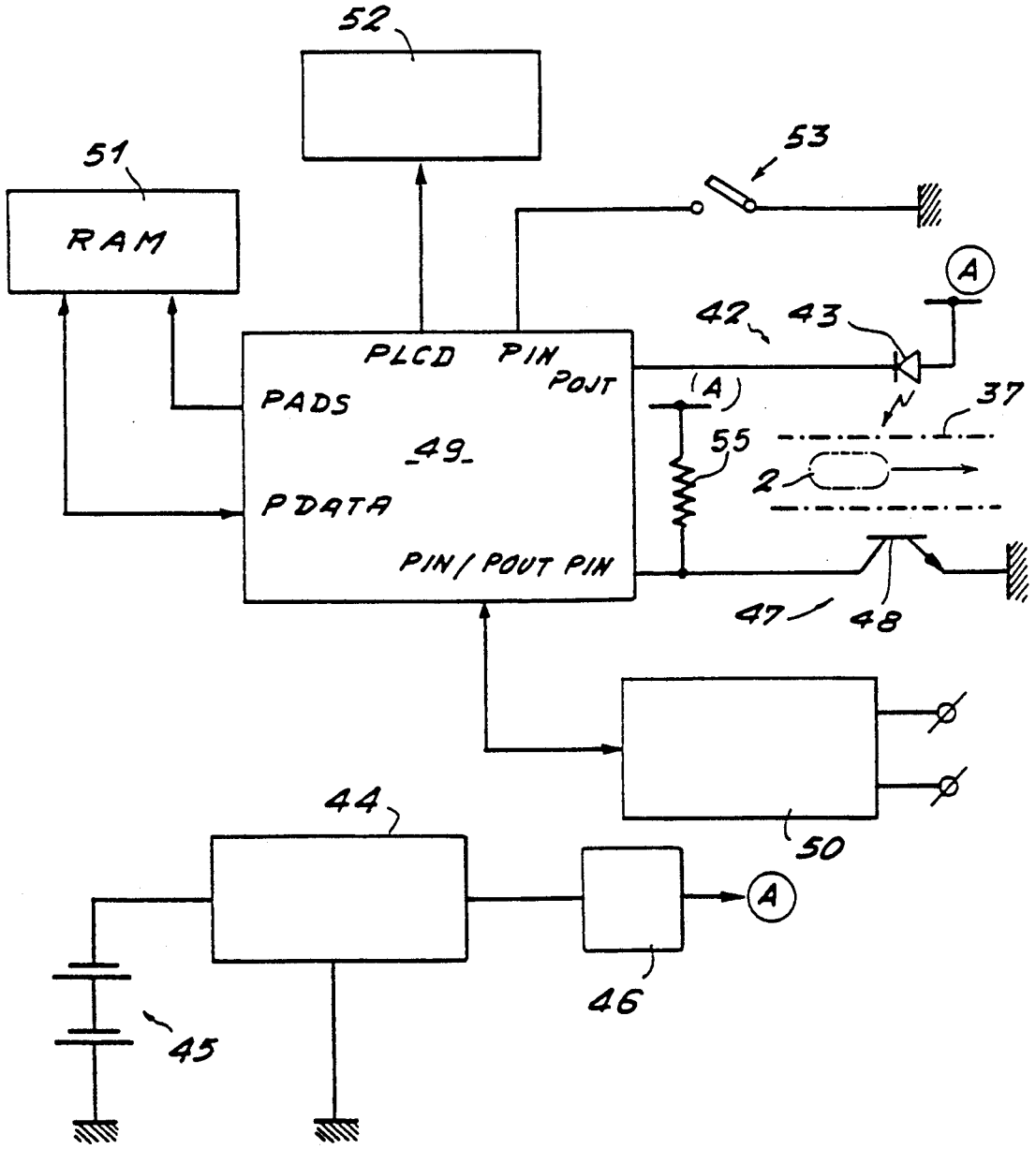
FIG. 4 is a circuit diagram showing the optical detection means used in the embodiment of the apparatus according to the invention more particularly described here.

In the embodiment more particularly described here, with reference to the diagram in FIG. 4, the detection means 39 comprise optoelectronic means 42 for emitting light radiation towards the inside of the channel. These means 42 comprise a photoemitter component 43, generally consisting of a light-emitting diode, associated with a current generator 44 supplied by a supply battery represented at 45, for example consisting of two 1.5 volt cells.

A circuit 46 makes it possible for example to adjust the light intensity.

The optical detection means also comprise means 47 for receiving the light emitted by the means 42, which are situated opposite the latter on the opposite lateral wall of the channel.

These reception means comprise a receiver 48, which may be a photodiode or a photocoupler represented by a transistor in FIG. 4. The base of the transistor is supplied by photons emitted in the channel by the means 42, the emitter/receiver circuit of the transistor being connected to the microprocessor 49 for computing and processing the signals received.

The circuit 47 is furthermore supplied by the generator 44 via a resistor 55 in a manner which is in itself known.

In response to the light emission, the receiver 48 therefore transmits to the microprocessor 49 an electrical signal which is representative of the level of light received.

When a capsule 2 passes through the passage conduit 37, the quantity of light received changes, which therefore has the effect of modifying the electrical signal transmitted by the receiver to the integrated circuit 49.

This integrated circuit is for example an NEC 75P008 microprocessor of the American company NEC Electronics programmed in a manner which is in itself known.

The circuit 49 is furthermore connected to an RS-232 series interface 50 (CCITT standard) for connection to external means (not shown) for processing and retrieving the data, which means are in themselves known, and may for example comprise a microprocessor.

The microprocessor 49 is also connected to a random-access memory 51 (RAM) for work and storage of data, and possibly to a read-only memory (ROM) which is not shown.

Display means, for example consisting of a liquid crystal screen 52, are provided and in particular make it possible, as a function of the programming of the microprocessor 49, to display data linked with the dispensing of the medications.

In the embodiment more particularly described here, a switch 53 which is normally open, capable of activating the operation of the dispensing apparatus, and which is automatically closed when the cap 22 is rotated, is also provided. It allows the energy consumption of the apparatus to be limited. Once the medication has been detected, for example after a given time delay, the switch opens again.

FIGS. 5 to 8 represent a second embodiment of an apparatus 60 according to the invention whose mechanical means 61 for driving the loader are integral with the lid 62 and not with the base 63 of the case 64.

Figure 5:
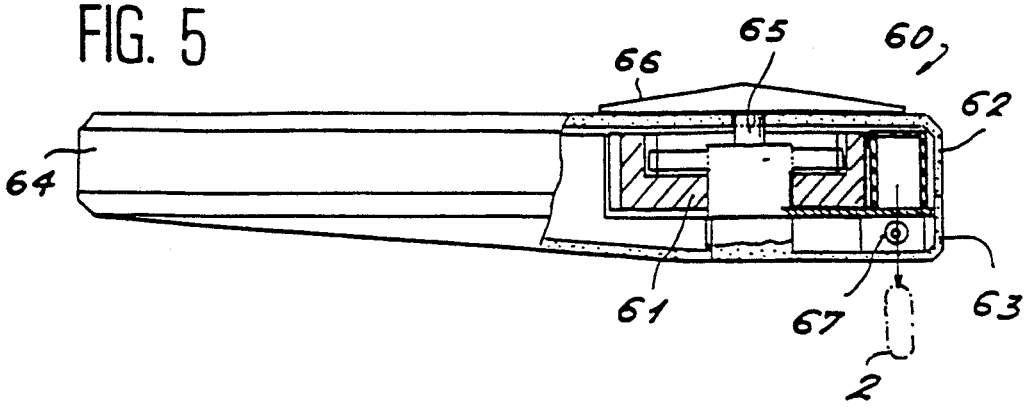
FIG. 5 is a side view, partially in section, of a second embodiment of the device according to the invention.

More precisely, FIG. 5 shows the case 64 closed. The means 61 are of similar design to the click drive means in FIGS. 1 to 3, with the difference that they are suspended via an axle 65, from the cap 66 for actuation by the user.

Figure 6:
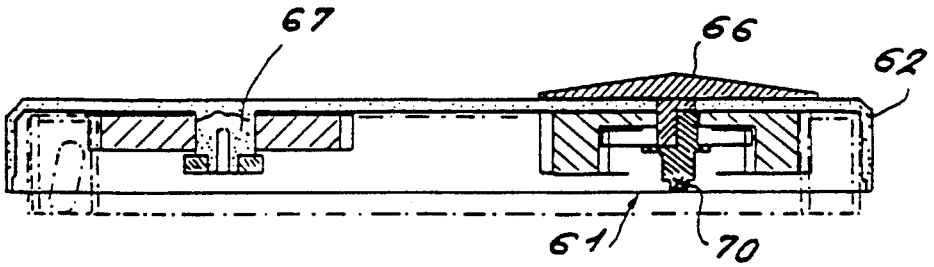
FIG. 6 is a side view, in section, of the upper part or lid of the case of the device in FIG. 5.

FIG. 6 diagrammatically shows the lid 62 fitted with drive means 61. The lid comprises a part 67 for fastening a screw 68 (see FIG. 7) making it possible to attach the base and the lid solidly together.

Figure 7:
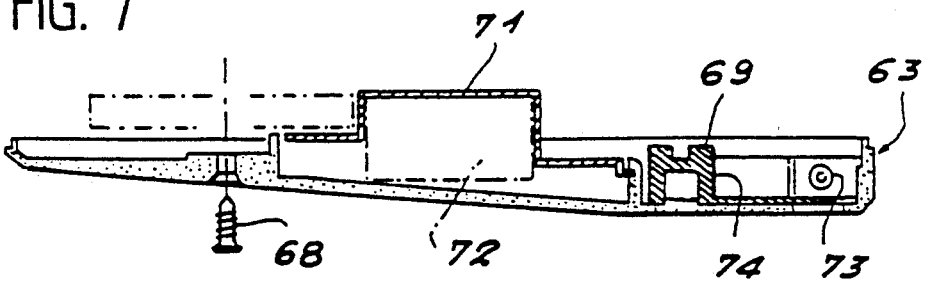
FIG. 7 is a side view, in section, of the lower part or base of the case in FIG. 5.

FIG. 7 shows the base 63 comprising on the one hand a part 69 capable of interacting with the end 70 of the axle of the driving means 61, when the lid is in place on the base. The base 63 also comprises a receptacle 71 capable of containing the optoelectronic detection circuits 72 connected to the means 73 for emitting and detecting radiation, which means are situated on the channel for exit of the medication.

The optical detection means 72 are for example of the same type as those described hereinabove with reference to FIG. 4.

The means for fastening the base onto the lid provided hereinabove can also and for example be actuated solely and in a manner which is known per se using a key (not shown).

Figure 8:
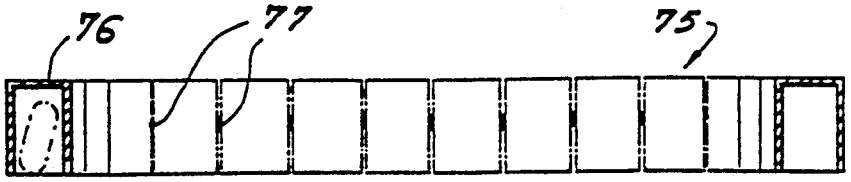
FIG. 8 is a side view of a loader used with the device in FIG. 5.

FIG. 8 is a section view of a loader 75 which can be used in the embodiment described hereinabove. This loader for example consists of a endless chain of cylindrical compartments 76, which are attached together using a cord 77.

The mode of us of the apparatus according to the invention more particularly described with reference to FIGS. 1 to 4 will now be described.

The apparatus according to the invention is advantageously a pocket apparatus, that is to say that its dimensions are relatively small and are for example contained within a parallelepiped measuring 7 cm by 12 cm by 4 cm in height.

The case is first of all open, the lid 6 being detached from the base 5 to which it was fixed for example using a lockable screw which, as has been seen, can only be actuated using a given locking key.

The loader 4 is then extracted from the base on which it freely rests, by simple fitting on the one hand into the teeth of the wheel 8 and on the other hand around the part 30. The latter has a horizontal section whose outline is in the shape of an ellipse portion, or substantially in the shape of an ellipse portion.

The part 30, integral with the base, is furthermore hollow and contains the electronic means. It makes it possible to guide the chain 4 with loose fit via its external surface, a small clearance of a few millimetres being for example provided between the chain and guide.

The chain is made of a material which is relatively flexible but has a rigid surface in the plane 36, which in particular allows substantially frictionless sliding when the rotation mechanism allowing the compartments 24 to be brought one by one opposite the exit orifice 35, is actuated.

When the loader 4 has been removed, it is inverted so that the closed part of the cylindrical compartments 28 is downwards.

The loader is then filled with the medications to be dispensed, for example thirty capsules disposed successively in each of the compartments of a chain which may for example comprise forty compartments.

The base is then placed above the cartridge or chain of the loader, by simple fitting in an easy manner, then the base is inverted into the operating position.

The capsules 2 therefore now rest on the plate 29. Advantageously, no capsule has been placed in the compartment which is placed initially above the orifice 35, because otherwise the said capsule would fall under gravity and would exit the case.

The lid 6 is then fixed, the cap 22 being placed so that the lug 21 interacts with the groove 20 of the This is done by trial and error in a manner which is known per se.

The lid is then locked with the base by virtue of the fastening means described hereinabove (represented by an axis 80 in FIG. 2).

The device is then ready to function, the batteries (1.5 volt cells) described in the context of FIG. 4, being of course charged in order to allow the electronic part of the device to operate.

In the embodiment more particularly described here with reference to FIG. 1, a mechanical device 81 comprising a flap 82 for closing the orifice 35 is furthermore provided. This flap is placed in the base and actuated by means 83.

For example, this flap 82 is made in a single piece with the means 83 which comprise a cylindrical tubular part 18' fitted onto the central axle 18 and linked in rotation with the bell 16, and therefore with the button 22 for driving the wheel.

The rotation of the button 22 drives the toothed wheel by one nick using the click arm device and at the same time opens the flap 82.

The flap then returns into the closed position at the same time as the click arms return into the initial position, by the action of a spring (not shown) placed in the base.

Other embodiments of the shutter or closure flap are of course possible. The latter may also more simply be placed at the level of the opening 38 in the plate 29 opposite the orifice 35. Such a device however does not allow permanent protection of the optical cells of the optoelectronic emitter/receiver device 37 in the part of the channel at 37.

In order to dispense a capsule, the user rotates the cap 22 by one step and thus brings a first compartment loaded with a capsule opposite the orifice 35 and the channel 37. The flap 82 retracts simultaneously.

The capsule falls directly under gravity and without any external action by the user through the orifice 38, the channel 37 and the orifice 35. The flap then automatically recloses as has been seen.

When it passes, the optoelectronic device records a change in intensity in the quantity of light received by the receiver 48, which leads to the recording of a signal a the microprocessor which is then able to process it.

This information is made compatible and stored in RAM 51 then recovered by the output 50 and conveyed towards the processing means (not shown) which can then, as required, perform the operations of computing the mean, medium, maximum and minimum values, standard deviation computations and in particular allow a report sheet to be made comprising for example the following information:

medication dispensed:
dosage:
identification of the patient:
date of the first recording:
date of the last recording:
number of capsules in the dispenser:
number of capsules remaining:
number of capsules used:
number of missing administrations:
average time breakdown of the administrations:

statistics on the variations with respect to the average time breakdowns and the delays between administrations, in which the mean, medium, maximum, minimum and standard deviation of these measurements are normally provided.

Of course, other information can be extrapolated and obtained in a manner which is known per se.

It is indeed within the ability of the person skilled in the art to adapt such means to a more specific dosage problem, simply by programming the microprocessor accordingly.

The present invention is not limited to the embodiments more particularly described. It relates on the contrary to all variants thereof and in particular:

those in which the compartments comprise transparent walls, the lateral wall of the case which covers the said compartments itself also being transparent either completely or partially, so as to allow the user to observe the contents of the case;

those in which means for emitting an audible signal remind the user of the time to take his medication;

those in which the number of compartments provided is larger, for example sixty or eighty compartments.

I claim:

1. Dispenser apparatus for medications in capsule or pill form, comprising:

a case having an exit orifice for said medications, a loader removable from said case comprising a plurality of transverse compartments forming a continuous longitudinal chain, each of said compartments being capable of containing at least one of said medications, each of said compartments having an open end located on one side in the direction of the exit orifice and a closed end on its other side, said case comprising:

means for driving the loader in a given direction, in order to bring each of the said medications successively, one by one, above the exit orifice of the case, and optical detection means disposed in proximity to said orifice, arranged in order to detect a passage of each of said medications at the moment of its exit from the case and connected to electronic means for storing, computing and retrieving data relating to said exit of medications, said loader and said orifice being arranged in order to allow said exit of each of said medications, directly and successively, under gravity, through said orifice.

2. Apparatus according to claim 1, wherein said orifice comprises a closure flap arranged so as to retract when a new compartment is presented above the said orifice and to reclose after the medication has passed.

3. Apparatus according to claim 1, wherein the compartments are cells of cylindrical or substantially cylindrical tubular shape, of a diameter between of the order of 8 mm and of the order to 1.5 cm and of a height between the order of 5 mm.

4. Apparatus according to claim 1, which further comprises means for connection to an external data processing and retrieval system.

5. Apparatus according to claim 1, wherein said means for driving the loader comprise a toothed wheel having outer teeth capable of guiding and meshing with the chain of compartments, said toothed wheel further having an axial bore provided with notches, and rotatable click arms engageable with said notches to rotate said toothed wheel.

6. Apparatus according to claim 1, wherein the loader comprises at least twenty compartments.

7. Apparatus according to claim 1, which comprises means for locking the case capable of preventing the removal of the removable loader, without the use of a key.

8. Apparatus according to claim 1, wherein the optical detection means comprise optoelectronic means comprising first means for emitting visual or infrared radiation and second means for receiving the said radiation, the said first and second means being placed opposite each other on a medication exit channel situated between a plane comprising the open end of each of said compartments and the exit orifice.

9. Apparatus according to claim 1, wherein the compartments and the lid of the case comprise an external wall which is at least partially transparent, so as to allow a user to observe the contents of said compartments.

* * * * *

UNITED STATES PATENT AND TRADEMARK OFFICE

CERTIFICATE OF CORRECTION

PATENT NO. : 5,310,082

DATED : May 10, 1994

INVENTOR(S) : Jean-Pierre COUSTENOBLE

It is certified that error appears in the above-identified patent and that said Letters Patent is hereby corrected as shown below:

In the Abstract line 5, after "includes" delete "a";

line 5, change "mechanism" to --means--.

line 7, after "detection" insert --means--;

line 9, delete "a", and change "device" to --means--.

Column 1, line 17, change "t" to --to--.

Column 2, line 32, change "ar" to --are--;

line 44, change "here" to --herein--.

Column 3, line 15, change "arm" to --arms--.

Column 5, line 27, change "us" to --use--.

Column 6, line 50, change "a" to --at--.

UNITED STATES PATENT AND TRADEMARK OFFICE

CERTIFICATE OF CORRECTION

PATENT NO. : 5,310,082

DATED : May 10, 1994

INVENTOR(S) : Jean-Pierre Coustenoble

It is certified that error appears in the above-indentified patent and that said Letters Patent is hereby corrected as shown below:

Claim 2, column 8, line 7, delete "said".

Signed and Sealed this

Sixth Day of September, 1994

*Attest:*

*Attesting Officer*

BRUCE LEHMAN

*Commissioner of Patents and Trademarks*